US009315313B2

(12) United States Patent
Kuwagaki et al.

(10) Patent No.: US 9,315,313 B2
(45) Date of Patent: Apr. 19, 2016

(54) DISPENSING CONTAINER

(75) Inventors: Denmi Kuwagaki, Chiba (JP); Masashi Fukumoto, Chiba (JP)

(73) Assignee: KIKKOMAN CORPORATION, Chiba (JP)

( * ) Notice: Subject to any disclaimer, the term of this patent is extended or adjusted under 35 U.S.C. 154(b) by 10 days.

(21) Appl. No.: 14/236,699

(22) PCT Filed: Jul. 20, 2012

(86) PCT No.: PCT/JP2012/068481

§ 371 (c)(1),
(2), (4) Date: Mar. 13, 2014

(87) PCT Pub. No.: WO2013/021802

PCT Pub. Date: Feb. 14, 2013

(65) Prior Publication Data

US 2014/0190992 A1 Jul. 10, 2014

(30) Foreign Application Priority Data

Aug. 5, 2011 (JP) ..... 2011-171850

(51) Int. Cl.

| | |
|---|---|
| ***B65D 35/28*** | (2006.01) |
| ***B65D 83/00*** | (2006.01) |
| ***B65D 77/06*** | (2006.01) |
| ***B65D 85/72*** | (2006.01) |

(52) U.S. Cl.

CPC ..... *B65D 83/0061* (2013.01); *B65D 77/06* (2013.01); *B65D 83/0055* (2013.01); *B65D 85/72* (2013.01)

(58) Field of Classification Search

USPC ..... 222/95, 105, 209, 386.5

See application file for complete search history.

(56) References Cited

U.S. PATENT DOCUMENTS

| | | | | |
|---|---|---|---|---|
| 3,223,289 | A * | 12/1965 | Bouet | 222/209 |
| 3,937,364 | A | 2/1976 | Wright | |
| 5,007,252 | A | 4/1991 | Mochizuki | |
| 5,529,213 | A * | 6/1996 | Mack et al. | 222/95 |
| 5,615,803 | A * | 4/1997 | Hatakeyama et al. | 222/94 |
| 6,708,850 | B2 * | 3/2004 | Uetake et al. | 222/189.06 |
| 6,742,676 | B2 * | 6/2004 | Nakamura et al. | 222/95 |

(Continued)

FOREIGN PATENT DOCUMENTS

| | | |
|---|---|---|
| EP | 1826137 A1 | 12/2004 |
| JP | 51-125581 A | 11/1976 |

(Continued)

OTHER PUBLICATIONS

Japanese Office Action received in corresponding Japanese Application No. 2011-171850 dated Feb. 25, 2016.

*Primary Examiner* — Donnell Long
(74) *Attorney, Agent, or Firm* — Mattingly & Malur, PC

(57) ABSTRACT

An object of the present invention is to facilitate discharge of the content in a dispensing container having a delamination structure so as to minimize the amount of remaining content. In order to achieve this object, a gas is housed in the internal container 11 to thereby form a gas space S therein and the volume of the gas is 4% or more of the volume of the internal container 11. The gas preferably moves rapidly in the internal container 11 when the dispensing container is tilted to a discharge posture in order to discharge the content M from the discharge port 14. The gas may be encapsulated in a gas bag or the gas may be encapsulated in a gas chamber formed in the internal container 11.

17 Claims, 11 Drawing Sheets

(56) References Cited

U.S. PATENT DOCUMENTS

| | | | | |
|---|---|---|---|---|
| 8,430,107 | B2 * | 4/2013 | Huang | 132/113 |
| 8,464,908 | B1 * | 6/2013 | Tabor | 222/95 |
| 2002/0130139 | A1 * | 9/2002 | Shiraishi et al. | 222/105 |
| 2002/0190079 | A1 * | 12/2002 | Hamamoto | 222/105 |
| 2009/0308888 | A1 | 12/2009 | Dairaku et al. | |

FOREIGN PATENT DOCUMENTS

| | | | |
|---|---|---|---|
| JP | 62-43660 | U | 3/1987 |
| JP | 3-27268 | A | 2/1991 |
| JP | 4-7443 | U | 1/1992 |
| JP | 9-278024 | A | 10/1997 |
| JP | 2001-106263 | A | 4/2001 |
| JP | 3688373 | B2 | 6/2005 |
| JP | 2005-350090 | A | 12/2005 |
| JP | 4024396 | B2 | 10/2007 |
| JP | 2008-162666 | A | 7/2008 |
| JP | 2009-149322 | A | 7/2009 |
| JP | 2009-149327 | A | 7/2009 |
| JP | 2011-31921 | A | 2/2011 |
| JP | 2011-111230 | A | 6/2011 |
| WO | 02/090211 | A1 | 11/2002 |
| WO | 2006/064567 | A1 | 6/2006 |

* cited by examiner

DISPENSING CONTAINER

TECHNICAL FIELD

The present invention relates to a dispensing container. More specifically, the present invention relates to improvements in the structure of a dispensing container having a delamination structure.

BACKGROUND ART

In terms of dispensing containers configured to discharge liquid content primarily by pressing the container, a delaminating container having an internal container (inner layer) containing liquid content and an external container (outer layer) on the inner side of which the internal container is layered has been in use in the related art. In general delaminating containers, the internal container is formed of a flexible material which deforms so as to deflate with a decreasing amount of the liquid content and the external container is formed of an elastically deformable material, with the external container sucking external air, in an amount according to the amount of discharged liquid content, from an external-air inlet port to introduce the external air in between the internal container and the external container (see, for example, Patent Documents 1 and 2).

RELATED ART REFERENCES

Patent Document

Patent Document 1: JP4024396 B
Patent Document 2: JP3688373 B

SUMMARY OF THE INVENTION

Problem to be Solved by the Invention

However, in the related-art delaminating containers, even when a user squeezes the container and thinks that all of the content thereof has been discharged, a part (for example, about 5-6%) of the content may still be remaining in the container.

An object of the present invention is to provide a dispensing container having a delamination structure capable of facilitating the discharge of its content so as to minimize the amount of content remaining therein.

Means for Solving the Problem

The inventors of the present invention have conducted various studies in order to solve the above problem. A significant characteristic of the related-art dispensing containers having the delamination structure (delaminating containers) described above resides in a structure capable of preventing the air from entering the internal container when content such as, for example, a liquid-type food is discharged, to thereby suppress contact between the content and the external air in order to prevent oxidation of such content. However, such structure may cause a situation in which a part of the content remains in the container even when the user squeezes the container strongly, trying to discharge all the content, and, despite the superior structure of the container, may sometimes cause the user to feel dissatisfied when he/she tries to use up the content. The inventors have focused on such phenomenon and conducted various studies to find the easiest way of using up the content and achieved findings which have led to a solution of the above problem.

The present invention is based on such findings and provides a dispensing container comprising: a container body having a flexible internal container which contains content and deforms so as to deflate with a decreasing amount of the content and an external container in which the internal container is attached, the external container being elastically deformed and provided with a suction port which sucks external air in between the internal container and the external container; a discharge cap which is attached to a spout of the container body, the discharge cap having, on its top part, a discharge port for discharging the content; an external-air inlet port which communicates between outside and the suction port; and an air valve which switches between a communicated state and a shutoff state of communication between the external-air inlet port and the suction port, wherein: a gas is housed in the internal container to thereby form a gas space; and a volume of the gas is 4% or more of a volume of the internal container.

One of the characteristics of the delaminating container resides in a structure in which the external air is prevented from entering the internal container to thereby break contact between the content and the external air. Despite such characteristic, the present invention dares to employ a configuration in which a gas is housed in the internal container, from the very beginning, to form a gas space therein. Since a gas is generally compressed more easily as compared to the content, when a user squeezes the container in an attempt to use up the content, the gas acts in such a way as to press the content. In the end, the gas in the gas space remains in the internal container in place of the content. Accordingly, it becomes possible to facilitate the discharge of the content and the amount of remaining content can be reduced as compared to the related art.

Furthermore, unlike the situation in which air is unintentionally introduced into the internal container of a delaminating container, the gas space having a volume of a predetermined level or more is intentionally formed in the internal container in the present invention. This configuration can provide a desirable advantageous effect in which the gas in the gas space is caused to remain in the internal container as a substitute for the content so that all the content can be discharged easily.

The gas preferably moves rapidly in the internal container when the dispensing container is tilted to a discharge posture in order to discharge the content from the discharge port.

In addition, the gas is preferably encapsulated in a gas bag in the dispensing container according to the present invention.

Alternatively, the gas may be encapsulated in a gas chamber formed in the internal container in the dispensing container according to the present invention. In this case, the gas chamber may be formed at the bottom on the inside of the internal container.

Effect of the Invention

According to the present invention, it is possible to facilitate the discharge of the content and minimize the amount of remaining content.

BEST MODE FOR CARRYING OUT THE INVENTION

A dispensing container according to an embodiment of the present invention will be described below with reference to the attached drawings.

Figure 1:
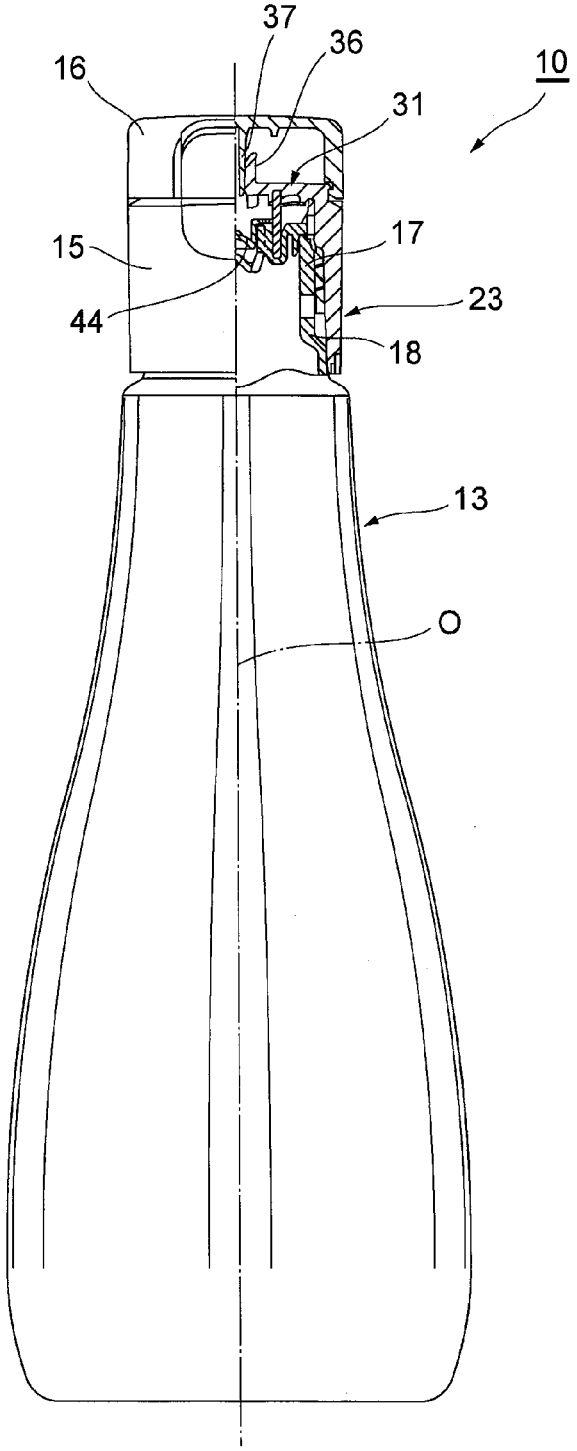
FIG. 1 is a partial cross-sectional view showing the entire dispensing container.

As shown in FIG. 1, a dispensing container 10 includes: a container body 13 having a flexible internal container 11 which contains content M and deforms so as to deflate with a decreasing amount of the content M, and an elastically-deformable external container 12 in which the internal container 11 is attached; a discharge cap 15 which is attached to a spout 13*a* of the container body 13 and provided with a discharge port 14 for discharging the content M; and an over-cap 16 which is removably arranged on the discharge cap 15.

The container body 13 is formed in a bottom-closed cylindrical shape and the over-cap 16 is formed in a top-closed cylindrical shape. The respective central axes of the container body 13 and over-cap 16 are arranged on a common axis in a covered state in which the over-cap 16 is attached onto the discharge cap 15 (see FIG. 8, etc.). In the following description: the common axis will be referred to as a container axis O; in a direction along this container axis O, the side of the over-cap 16 will be referred to as an upper side, while the side of a bottom (not shown) of the container body 13 will be referred to as a lower side; the direction orthogonal to the container axis O will be referred to as a radial direction; and the direction about the container axis O will be referred to as a circumferential direction.

Figure 2:
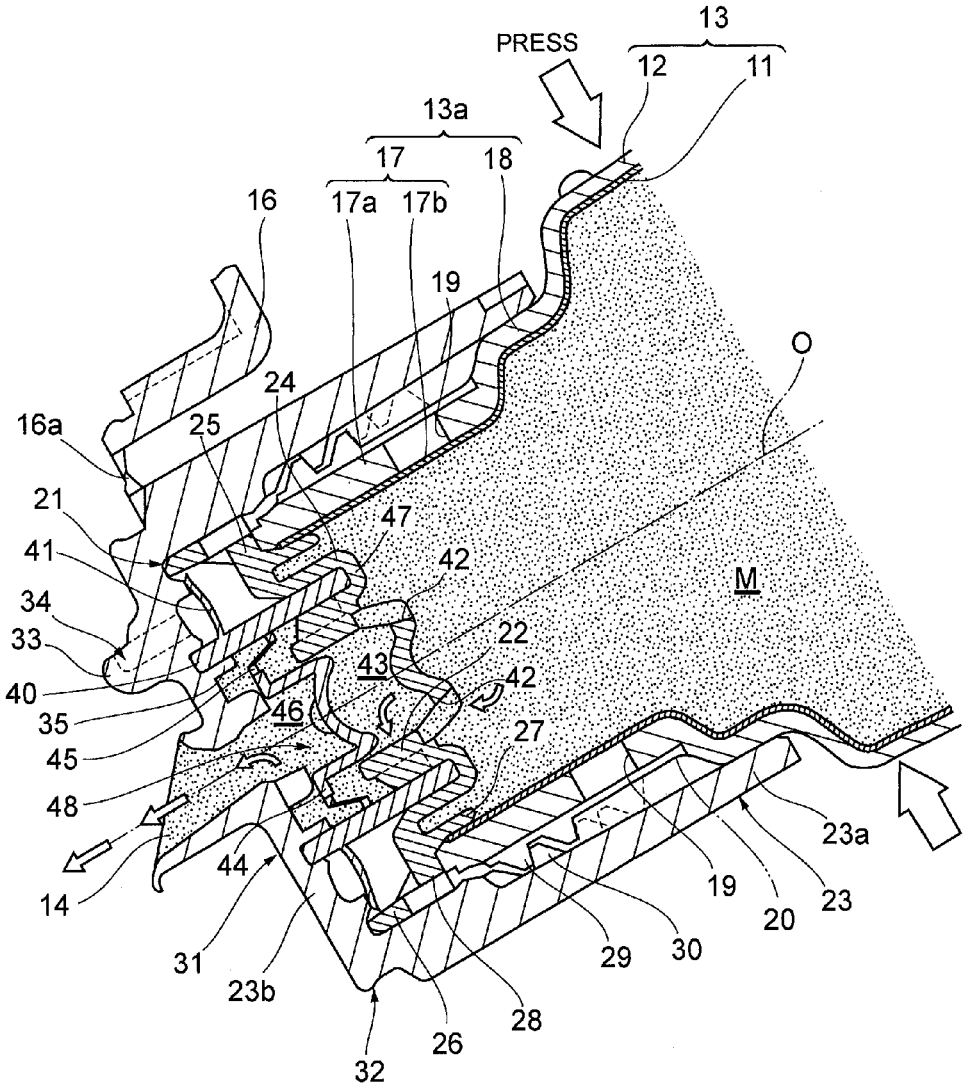
FIG. 2 is a vertical cross-sectional view explaining how the dispensing container acts when discharging the content.

The over-cap 16 may be connected via a hinge 16*a* to the discharge cap 15 (see FIG. 2, etc.). The hinge 16*a* is arranged at a position higher than the discharge port 14 in a state in which the dispensing container 10 is tilted in a discharge posture so as to direct the discharge port 14 downward, in order for the over-cap 16 not to be an obstacle when the content M is discharged from the discharge port 14.

The container body 13 is formed as a so-called "delamination bottle" in which the internal container 11 is layered on an inner surface of the external container 12 in a delaminatable manner. The container body 13 is molded by, for example, blow-molding a co-extruded two-layered parison. The external container 12 is made of, for example, polyethylene resin, polypropylene resin, or the like, while the internal container 11 is made of, for example, a material incompatible with the resin forming the external container 12, such as a polyamide-based synthetic resin or an ethylene-vinyl-alcohol copolymer resin.

The spout 13*a* of the container body 13 is formed as a stepped cylindrical shape having an upper cylindrical part 17 located on the upper side and a lower cylindrical part 18 located on the lower side and formed so as to have a diameter larger than that of the upper cylindrical part 17 (see FIG. 2, etc.). In the upper cylindrical part 17, an outer peripheral surface of a portion (hereinafter referred to as an "external upper cylindrical part") 17*a*, which is constituted by the external container 12, is provided with an external thread 29. In the external upper cylindrical part 17*a*, a suction port 19 is provided at a position lower than the external thread 29, with the suction port 19 introducing the external air in between the external container 12 and the internal container 11 (see FIG. 3, etc.). A communication groove 20 extending in the container axis O direction is formed in a portion located above the suction port 19 in the external thread 29.

An inner peripheral surface of the external upper cylindrical part 17*a* is defined as a cylindrical surface, and a portion (hereinafter referred to as an "internal upper cylindrical part") 17*b*, which is constituted by the internal container 11, in the upper cylindrical part 17 is layered on the inner peripheral surface of the external upper cylindrical part 17*a* (see FIG. 2, etc.). An upper end portion of the internal upper cylindrical part 17*b* is folded radially outward and arranged at an opening end of the external upper cylindrical part 17*a*.

The discharge cap 15 includes: an inside plug member 21 which closes the spout 13*a* of the container body 13; and a cylindrical body member 23 formed in a top-closed cylindrical shape, the cylindrical body member 23 covering the inside plug member 21 and being provided with the discharge port 14 (see FIG. 2, etc.). The inside plug member 21 includes: a plug body 47 having the outer circumferential end thereof arranged at the opening end of the spout 13*a* of the container body 13; and a cylindrical communicating part 22 which is formed upright from the plug body 47.

The plug body 47 includes: a bottom-closed internal cylindrical part 24 which is arranged in the spout 13*a* of the container body 13 with a gap between the internal cylindrical part 24 and the spout 13*a*; a flange 25 which is formed so as to protrude radially outward from an upper end of the internal cylindrical part 24 and arranged at the opening end of the spout 13*a* of the container body 13; an external cylindrical part 26 extending upward from an outer circumferential edge of the flange 25; and a middle cylindrical part 27 extending downward from the flange 25 so as to surround the internal cylindrical part 24 from the radially outer side, the middle cylindrical part 27 being fitted into the spout 13*a* of the container body 13 in a liquid-tight manner (see FIG. 2, etc.). Such internal cylindrical part 24, flange 25, external cylindrical part 26 and middle cylindrical part 27 are arranged coaxially with the container axis O. An external-air passage port 28 is formed at a lower end of the external cylindrical part 26, the external-air passage port 28 extending therethrough in the radial direction and opening downward.

The above-mentioned cylindrical communicating part 22 is arranged at a bottom wall of the internal cylindrical part 24.

In addition, a through hole 42 is formed thorough the bottom wall, the through hole 42 opening into both the internal container 11 and the cylindrical communicating part 22. The through hole 42 is, for example, constituted by a plurality of small holes evenly arranged about the container axis O (see FIG. 2, etc.).

The cylindrical body member 23 is arranged coaxially with the container axis O and formed in a top-closed cylindrical shape. An inner peripheral surface of a peripheral wall 23*a* of the cylindrical body member 23 is provided with an internal thread 30 which is screwed with the external thread 29 in the spout 13*a* of the container body 13. A lower cylindrical part 18 in the spout 13*a* of the container body 13 is fitted in an airtight manner into a lower end portion located below a threaded portion, in which the internal thread 30 is formed, in the peripheral wall 23*a*, and the external cylindrical part 26 of the inside plug member 21 is fitted into an upper end portion located above the threaded portion.

Figure 5:
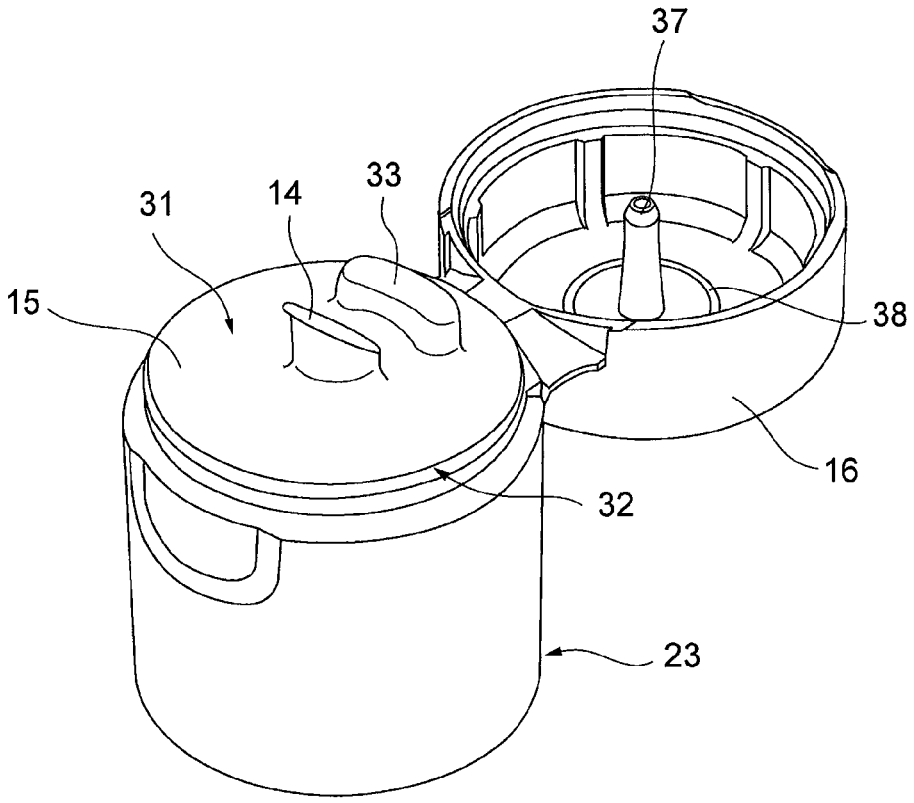
FIG. 5 is a perspective view showing the discharge cap with the over-cap opened.
Figure 6:
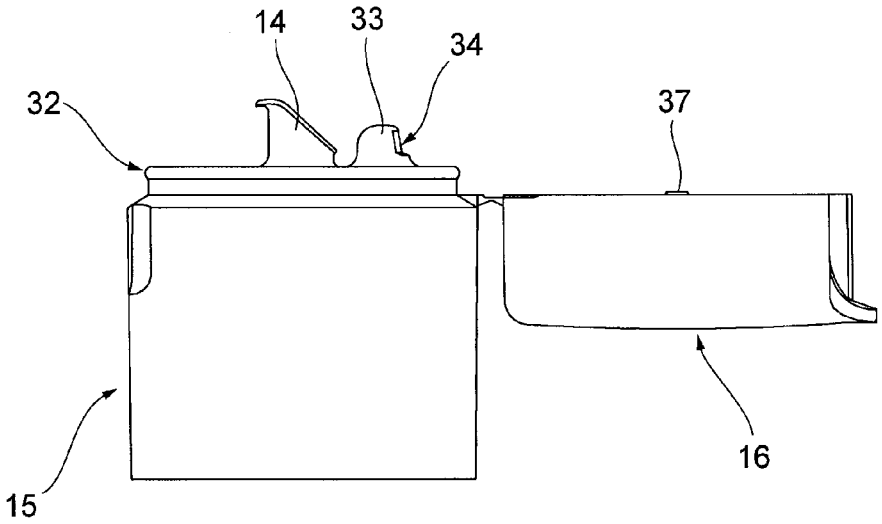
FIG. 6 is a side view showing the discharge cap with the over-cap opened.
Figure 7:
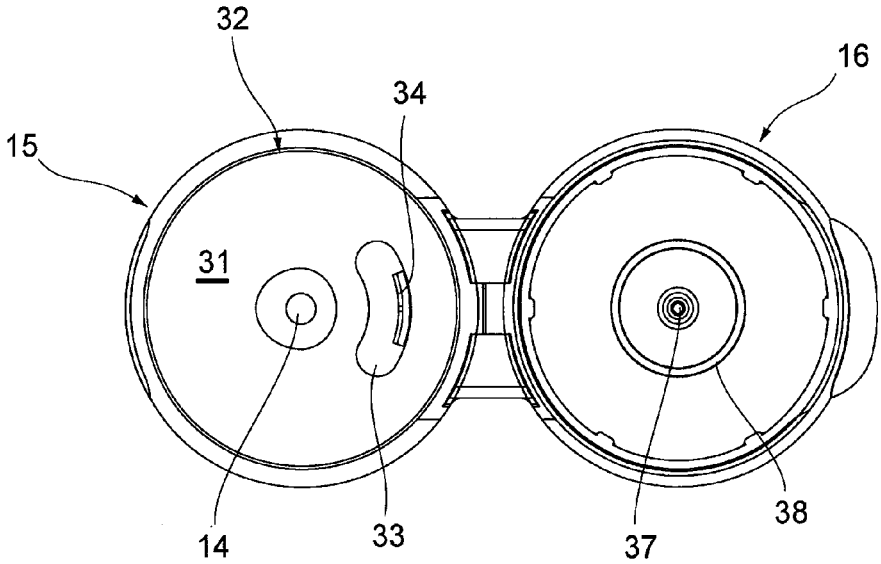
FIG. 7 is a plan view showing the discharge cap with the over-cap opened.

A discharge port 14 for discharging the content M is formed in a top part 31 of the discharge cap 15 (see FIG. 5, etc.). Although the discharge port 14 is formed so as to be coaxial with the container axis O (see FIG. 2, etc.) in the dispensing container 10 of this embodiment, the discharge port 14 may alternatively be formed at a position shifted from the container axis O.

In addition, an external-air inlet protrusion 33 protruding upward is formed in the top part 31 of the discharge cap 15 and an external-air inlet port 34 is formed in the external-air inlet protrusion 33 (see FIG. 2, etc.). In order to prevent the content M from being sucked from the external-air inlet port 34, the external-air inlet protrusion 33 is formed at a position higher than the discharge port 14 in the discharge posture where the dispensing container 10 is tilted so as to discharge the content M from the discharge port 14 (see FIG. 2, etc.).

In this embodiment, for example, the external-air inlet protrusion 33 is formed upright between the discharge port 14 and the hinge 16*a* and the external-air inlet port 34 is arranged at a position higher than the top part 31 with a spatial distance from the top part 31. Thus, even if the content M which has dripped from the discharge port 14 adheres to an outer surface of the discharge cap 15, hardly any of the dripped content M will be sucked from the external-air inlet port 34. In addition, the external-air inlet port 34 is formed so as to be opened upward, more preferably opened vertically upward with respect to the external-air inlet protrusion 33*c* when the dispensing container 10 is tilted in the discharge posture in order to discharge the content from the discharge port 14 (see FIG. 2 etc.).

The specific shape of the above external-air inlet protrusion 33 is not particularly limited. However, in the above embodiment, for example, the external-air inlet protrusion 33 is formed in a curved shape along a circular arc extending about the discharge port 14, the curved shape having a circumferential length larger than a thickness in the radial direction of the discharge cap 15 (the direction orthogonal to the container axis O direction) (see FIG. 5). The external-air inlet protrusion 33 having such shape can block the content M which has, for example, dripped and adhered to the outer surface of the discharge cap 15, from approaching the external-air inlet port 34 and thereby prevent the content M from being sucked into the external-air inlet port 34. Such external-air inlet protrusion 33 is also preferably curved along a circular arc extending about the discharge port 14.

The discharge cap 15 is provided with an engagement part 32 with which the over-cap 16 is to be engaged in the covered state. In this embodiment, for example, a step which is slightly overhanging in the radial direction is formed on the periphery of the top part 31 of the discharge cap 15 and this step constitutes the engagement part 32 with which the over-cap 16 is to be engaged in the covered state (see FIGS. 2, 5, etc.).

It is preferable for the top part 31 to be formed smoothly. In the dispensing container 10 of this embodiment, for example, a part of the top part 31, excluding a portion where the discharge port 14 is formed and a portion where the external-air inlet protrusion 33 is formed, is formed as a smooth surface. In this case, even if the content M, which has, for example, dripped, adheres to the top part 31 of the discharge cap 15, it can easily be wiped off even by a quick wiping motion.

The top part 31 is provided with a cylindrical receiver 35 which extends downward and whose outer diameter is approximately the same as the internal diameter of an externally-fitted cylindrical part 40 (to be described later). In addition, a discharge pipe 36, the interior of which defines the discharge port 14, extends through an upper plate 32.

Figure 8:
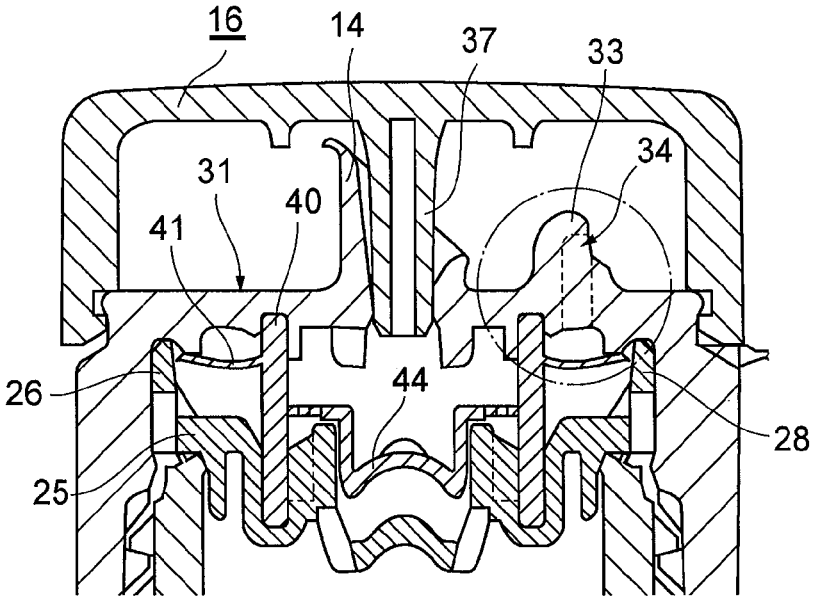
FIG. 8 is a vertical cross-sectional view showing a part of the discharge cap being covered with the over-cap.

An inner cylindrical seal part (seal part) 37 extending downward from the over-cap 16 is fitted into the discharge pipe 36 (see FIGS. 1, 5, 8, etc.). In addition, an annular projection 38 is formed around the inner cylindrical seal part 37 so as to protrude downward from the back surface of the over-cap 16 (see FIG. 5, etc.).

Figure 4:
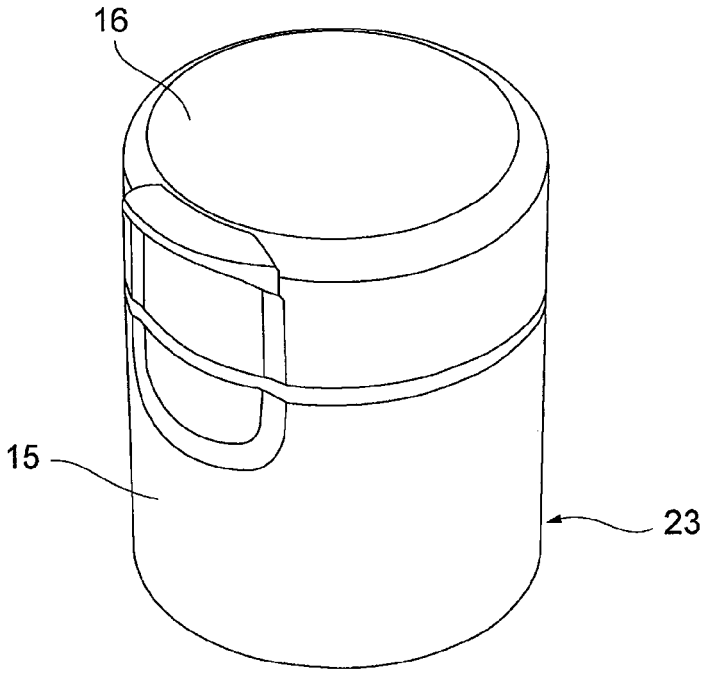
FIG. 4 is a perspective view showing a discharge cap being covered with an over-cap.
Figure 9:
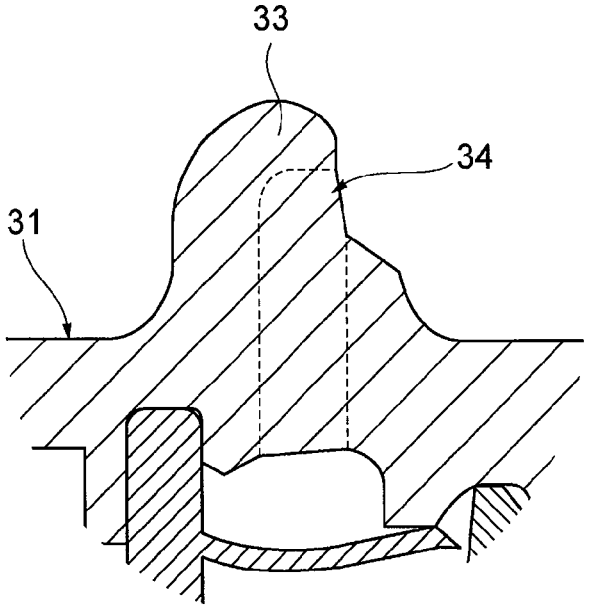
FIG. 9 is a view showing a part of FIG. 8 in an enlarged manner.

The over-cap 16 is further provided with an external-air inlet port sealing part 39 for closing the external-air inlet port 34 in a state where the over-cap 16 is attached to the discharge cap 15 (see FIGS. 8 and 9). By attaching the over-cap 16 to the discharge cap 15 during non-use or transportation of the dispensing container 10, the external-air inlet port sealing part 39 prevents the content M from being unintentionally sucked into the external-air inlet port 34 (see FIGS. 4 and 8).

An externally-fitted cylindrical part 40, which is externally fitted with the cylindrical communicating part 22 of the inside plug member 21, is arranged between the inside plug member 21 and the cylindrical body member 23. The externally-fitted cylindrical part 40 is arranged coaxially with the container axis O. A lower end portion of the externally-fitted cylindrical part 40 is externally fitted with the cylindrical communicating part 22 and also fitted into the internal cylindrical part 24 of the inside plug member 21. An upper end portion of the externally-fitted cylindrical part 40 is externally fitted with the cylindrical receiver 35 of the cylindrical body member 23.

Figure 3:
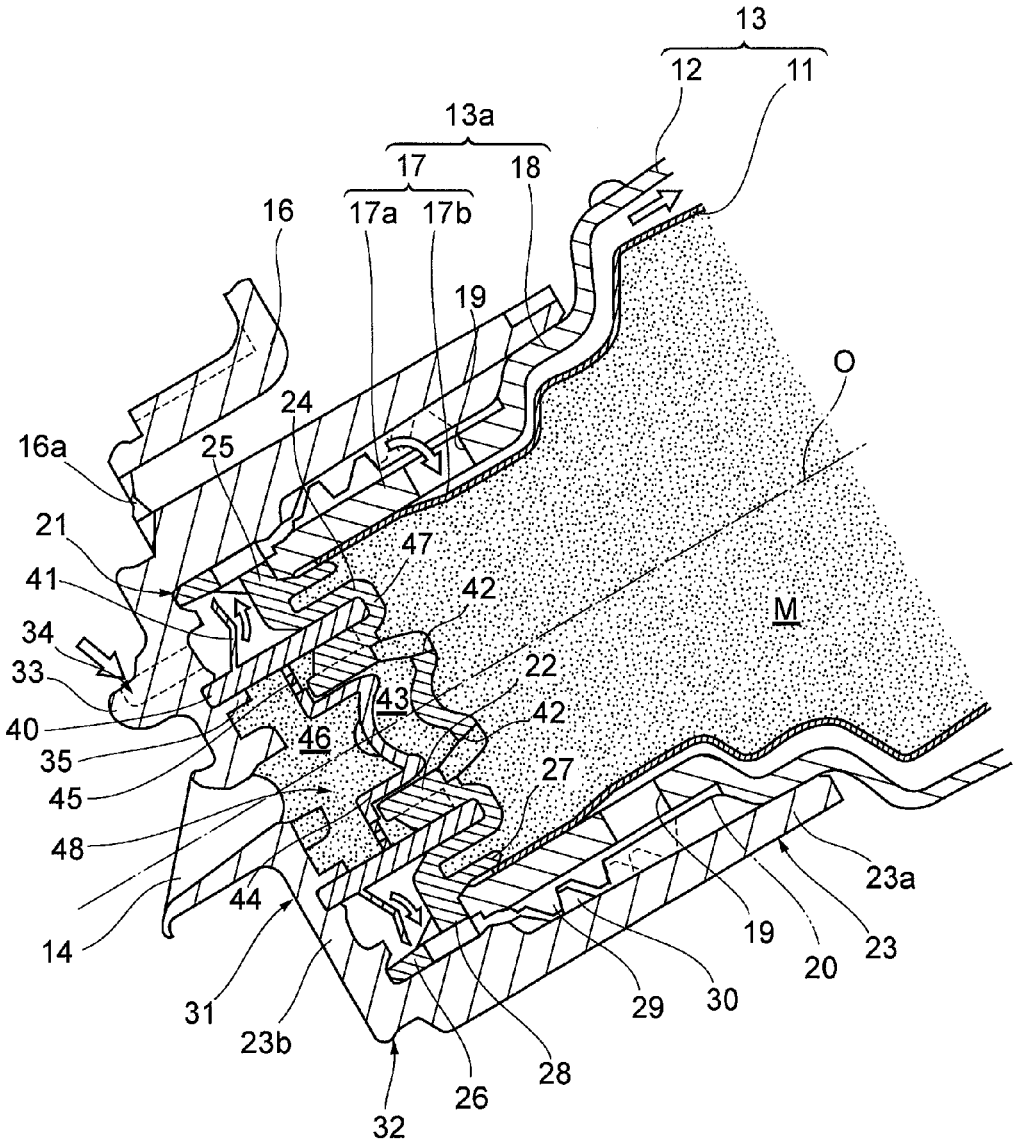
FIG. 3 is a vertical cross-sectional view explaining how the dispensing container acts when restoring after the discharge of the content.

An annular air valve 41 is provided in the middle, in the container axis O direction, of the externally-fitted cylindrical part 40, so as to protrude radially outward (see FIGS. 2 and 3). The air valve 41 is elastically deformable and switches between a communicated state and a shutoff state of the communication between the suction port 19 and the external-air inlet port 34.

The inside plug member 21 is provided with a communication recess 43 which communicates between the discharge pipe 36 and the internal container 11. The communication recess 43 is defined by the interior of the cylindrical communicating part 22 and is arranged coaxially with the container axis O. With such configuration, the container axis O direction and the axial direction of the communication recess 43 coincide with each other. In the illustrated example, the communication recess 43 is located below the discharge pipe 36, i.e., on the inner side of the internal container 11 along the container axis O direction. In addition, the internal volume of the communication recess 43 is larger than the internal volume of the discharge pipe 36.

A valve body 44 is arranged and fitted into the cylindrical communicating part 22 of the inside plug member 21 so as to be slidable along the container axis O direction, and the valve body 44 slides along the container axis O direction so as to open and close the communication recess 43. The valve body 44 is formed in a bottom-closed cylindrical shape arranged coaxially with the container axis O and its movement is restricted due to its shape having an annular flange which protrudes radially outward from an end on the upper side (upper end) in the container axis O direction. An annular upper end surface of the cylindrical communicating part 22 functions as a valve seat (valve holder) for the valve body 44, with the valve seat abutting onto the flange and receiving the valve body 44. In this configuration, an outer peripheral surface of the valve body 44 and an inner peripheral surface of the communication recess 43 may be configured so as to barely come into contact with each other, or the bottom surface of the valve body 44 may be configured so as not to abut onto a portion located on the radially inner side with respect to the cylindrical communicating part 22 in the plug body 47.

An upper end of the valve body 44 is abutted onto the upper end surface of the cylindrical communicating part 22 or located above the upper end surface and, as shown in FIGS. 2 and 3, the upper end of the valve body 44 is connected to one end of each of a plurality of elastic connecting pieces 45 which connect the valve body 44 and the externally-fitted cylindrical part 40 to each other. The plurality of elastic connecting pieces 45 (in the illustrated example, three elastic connecting pieces 45) are arranged circumferentially with gaps therebetween, each of which is circumferentially curved. The positions of both ends of each elastic connecting piece 45 approximately coincide with each other in the container axis O direction. It should be noted that the valve body 44, the externally-fitted cylindrical part 40, the elastic connecting pieces 45 and the air valve 41 are integrally formed so as to constitute a connector 48.

Next, the effect of the dispensing container 10 having the above configurations will be described below.

As shown in FIG. 2, when the content M is discharged from the dispensing container 10, the over-cap 16 is first removed from the discharge cap 15. Then, in a state in which the dispensing container 10 is tilted in a discharge posture so that the discharge port 14 is directed downward relative to the horizontal plane, the dispensing container 10 is pressed radially inward so as to be squeezed and deformed (elastically deformed), and the internal container 11 is deformed together with the external container 12 so as to reduce the volume thereof.

As a result, the pressure inside the internal container 11 increases so as to cause the content M in the internal container 11 to press the valve body 44 via the through hole 42, the elastic connecting pieces 45 are elastically deformed so as to cause the valve body 44 to be slid along the container axis O direction toward the outside of the internal container 11, and the communication recess 43 is opened. As a result, the content M in the internal container 11 is discharged via the through hole 42, the communication recess 43, the externally-fitted cylindrical part 40 and the discharge port 14, to the outside (see FIG. 2).

Then, by stopping or releasing the pressing against the dispensing container 10 so as to weaken the pressing force of the content M in the internal container 11 against the valve body 44, a pressure difference resulting from the elastic restoring force of the dispensing container 10 causes the valve body 44 to be slid along the container axis O direction toward the inner side of the internal container 11 (see FIG. 3).

At this time, when the valve body 44 enters the communication recess 43, as shown in FIG. 3, the outer peripheral surface of the valve body 44 is brought into contact with and slid along the inner peripheral surface of the communication recess 43 to thereby shut off a gap between the valve body 44 and the communication recess 43. As a result, an internal space 46, in which the content M which has not been returned to the internal container 11 remains, is formed between the cylindrical body member 23 and the inside plug member 21. The internal space 46 communicates with the discharge port 14 and has the valve body 44 as a part of its delimiting walls. The valve body 44 shuts off the communication between the internal space 46 and the communication recess 43.

When, after the internal space 46 is formed as described above, the valve body 44 continues to slide in the communication recess 43 along the container axis O direction, the internal volume of the internal space 46 increases in accordance with the sliding motion of the valve body 44. Accordingly, it becomes possible to introduce the content M in the discharge port 14 into the internal space 46 and to suck the external air A into the discharge port 14.

When the pressing against the container body 13 is released in the state where the communication recess 43 is being shut off by the valve body 44, the external container 12 will be restored to the original shape while the internal container 11 remains deformed in its reduced volume. At this time, negative pressure is generated between the internal container 11 and the external container 12, and the negative pressure acts on the air valve 41 via the suction port 19 and causes the air valve 41 to be opened. Then, external air is sucked in between the external container 12 and the internal container 11 via the external-air inlet port 34, the external-air passage port 28, the communication groove 20 and the suction port 19 (see FIG. 3). When the internal pressure between the external container 12 and the internal container 11 increases so as to match the atmospheric pressure, the air valve 41 is restored to the original shape and shuts off the suction port 19 from the outside. As a result, the reduced-volume shape of the internal container 11 is retained after the discharge of the content M.

From this state, when the external container 12 of the container body 13 is squeezed and deformed again, the internal pressure between the external container 12 and the internal container 11 becomes positive due to the shutoff state of the air valve 41, and this positive pressure causes the internal container 11 to be deformed so as to reduce the volume thereof and the content M is discharged due to the aforementioned effect.

If, after the content M is discharged and before the communication recess 43 is shut off by the valve body 44, the pressing against the dispensing container 10 is not only stopped but also released, the internal container 11 will be restored to its original shape by following the behavior of the external container 12. Then, the pressure inside the internal container 11 will decrease to negative and this negative pressure will act on the valve body 44, so that the valve body 44 is smoothly slid along the container axis O direction toward the inner side of the internal container 11.

As described above, since the dispensing container 10 according to this embodiment allows, after the discharge of the content M, the content M in the discharge port 14 to be introduced into the internal space 46 and allows the external air A to be sucked into the discharge port 14, it becomes possible to prevent the content M which has not been returned to the internal container 11 from remaining in the discharge port 14. With such configuration, the content M can be prevented from leaking out of the discharge port 14 after the discharge of the content M.

In addition, since the through hole 42 has a smaller diameter than that of the communication recess 43, even if the valve body 44 is unintentionally displaced toward the inner side of the internal container 11 along the axial direction, the flange of the valve body 44 will still abut onto the annular upper end surface of the cylindrical communicating part 22 of the plug body 47 and such unintentional displacement of the valve body 44 will still be able to be restricted.

If the valve body 44 abuts onto the plug body 47 when the dispensing container 10 is not being operated as in this embodiment, the communication between the communication recess 43 and the through hole 42 can be shut off by the valve body 44. In this case, when the valve body 44 is displaced so as to be restored after the content M is discharged and the internal space 46 is formed as described above, the valve body 44 can be slid in the communication recess 43 over the entire length of the communication recess 43 along the container axis O direction. This can ensure that the internal volume of the internal space 46 increases and the aforementioned effects and advantages can be significantly exerted.

Since the inner cylindrical seal part 37 is provided in the over-cap 16, the content M can be prevented from being unintentionally leaked out of the discharge port 14 with the over-cap 16 being closed. After the discharge of the content M, hardly any of the content M which has not been returned to the internal container 11 remains in the discharge port 14, as described above. Thus, when the over-cap 16 is attached onto the discharge cap 15 after the discharge of the content M and the inner cylindrical seal part 37 is fitted into the discharge port 14, the content M can be prevented from being pressed out of the discharge port 14 by the inner cylindrical seal part 37 and the content M can be prevented from adhering to the inner cylindrical seal part 37.

It should be noted that the technical scope of the present invention is not limited to the embodiment above and various modifications may be added without departing from the gist of the present invention.

Figure 10:
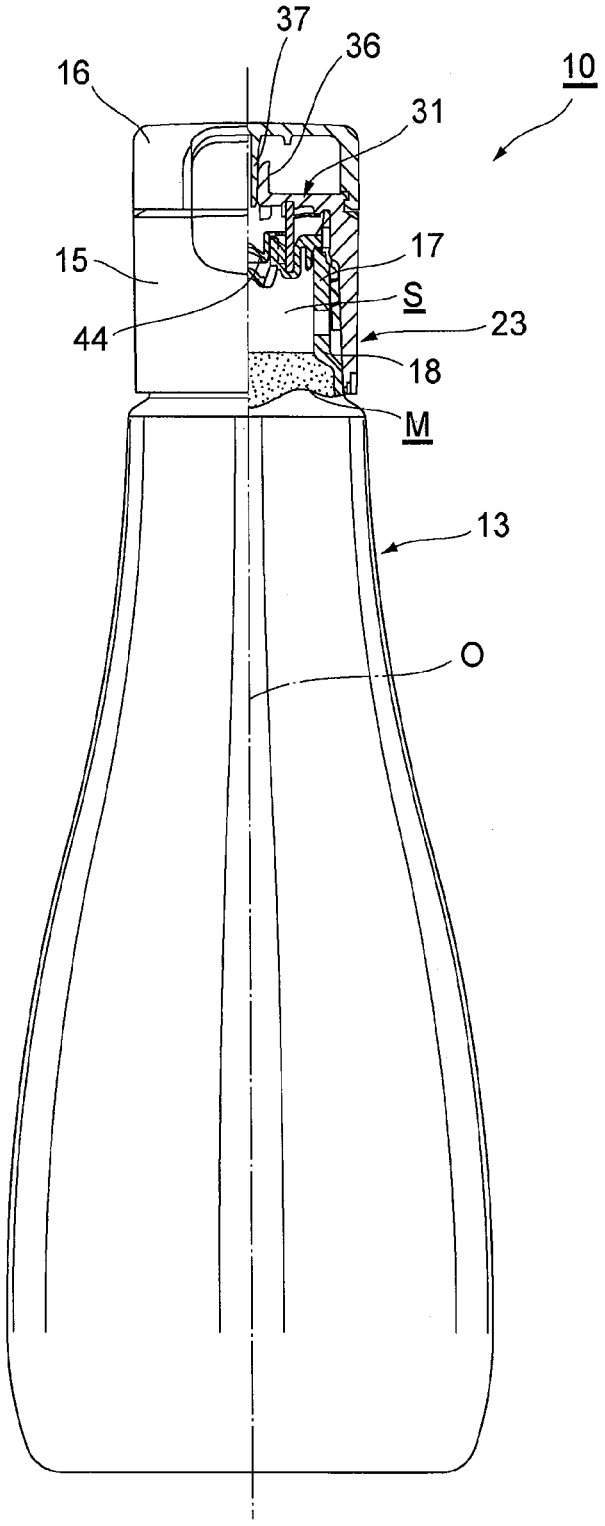
FIG. 10 is a partial cross-sectional view showing the entire dispensing container according to an embodiment of the present invention.
Figure 11:
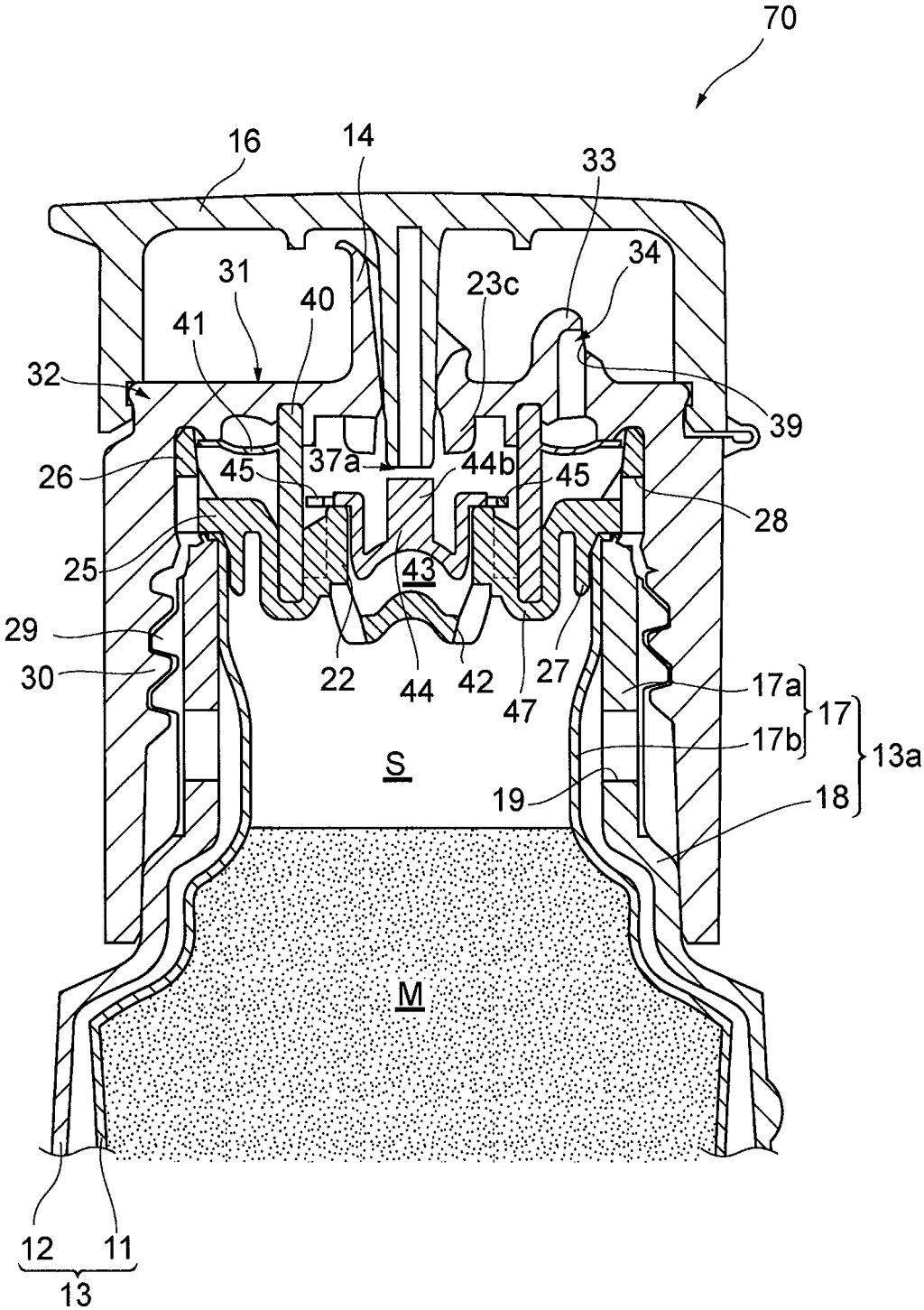
FIG. 11 is a vertical cross-sectional view showing a primary part of a dispensing container according to the embodiment of the present invention.

Another embodiment of the present invention is shown in FIG. 10, etc. In this embodiment, a gas is housed inside the internal container 11, in advance, to thereby form a gas space S (see FIGS. 10 and 11). The gas in this gas space S can be compressed more easily than can the content M. Thus, especially when the volume of the remaining content M becomes small and a user presses (squeezes and deforms) the dispensing container 10 in an attempt to use up the content M, the gas acts to discharge the content M more effectively.

The effect of the gas space S will be described below. Since the specific gravity of the gas is lighter than that of the content M, the gas space S exists as a headspace located above the content M in the vertical direction in the normal state where the dispensing container 10 is being placed with the discharge cap 15 oriented upward (see FIG. 11, etc.). From this state, when the dispensing container 10 is tilted to the discharge posture so as to direct the discharge port 14 downward relative to the horizontal plane, the gas space S moves in the internal container 11 toward the bottom of the dispensing container 10. When the dispensing container 10 in such discharge posture is pressed by the user, only the content M is discharged from the discharge port 14 and the gas forming the gas space S remains in the internal container 11.

In such dispensing container 10, since the ratio of the gas space S to the amount of the remaining content M increases with a decreasing amount of the content M, the effect of pressing (discharging) the content M by the gas space S, which has been compressed during being pressed, to be exerted with respect to the content M becomes larger. Accordingly, especially when the amount of remaining content M becomes small, the pressed and compressed gas space S acts on the content M so as to press and discharge the content M more effectively. The gas in the gas space S finally remains in the internal container 11 as a substitute for the content M. Therefore, the dispensing container 10 according to the invention of the present application is capable of facilitating the discharge of the content M and reducing the amount of remaining content M as compared to the related art.

The gas preferably moves rapidly in the internal container 11 when the dispensing container 10 is tilted to the discharge posture in order to discharge the content M from the discharge port 14. Although the speed of movement of the gas in this case may vary depending on the volume of the gas, the shape of the internal container 11, etc., it is most significantly affected by the viscosity of the content M. In terms of the object of facilitating the discharge of the content M so as to minimize the amount of remaining content M, the viscosity of the content M is preferably within a range which allows the gas to move somewhat rapidly (see Example 2).

It should be noted that specific examples of the content M are not limited and may include, as non-limiting examples, various types of contents such as emulsified liquids, modified starch mixtures, liquid-type foods and soy sauce-containing flavoring materials (an example of clear flavoring materials, including soy sauce itself). Although specific examples of the gas are not limited, either, the gas may preferably be selected from those having low reactivity, such as nitrogen gas, which barely causes, for example, oxidization of the content M.

The above description has described an embodiment in which the gas is housed together with the content M in the internal container 11. However, the gas space S may be formed in a different way from the embodiment above. For example, the gas space S may be formed by housing a gas bag 50, which encapsulates the gas, in the internal container 11 (see FIG. 12). In such dispensing container 10, the gas space S is retained in the internal container 11 until all the content M has been discharged. It is preferable that the material and shape of the gas bag 50 are those that allow for the gas bag 50 itself to move rapidly in the internal container 11 when, for example, the dispensing container 10 is tilted.

Figure 12:
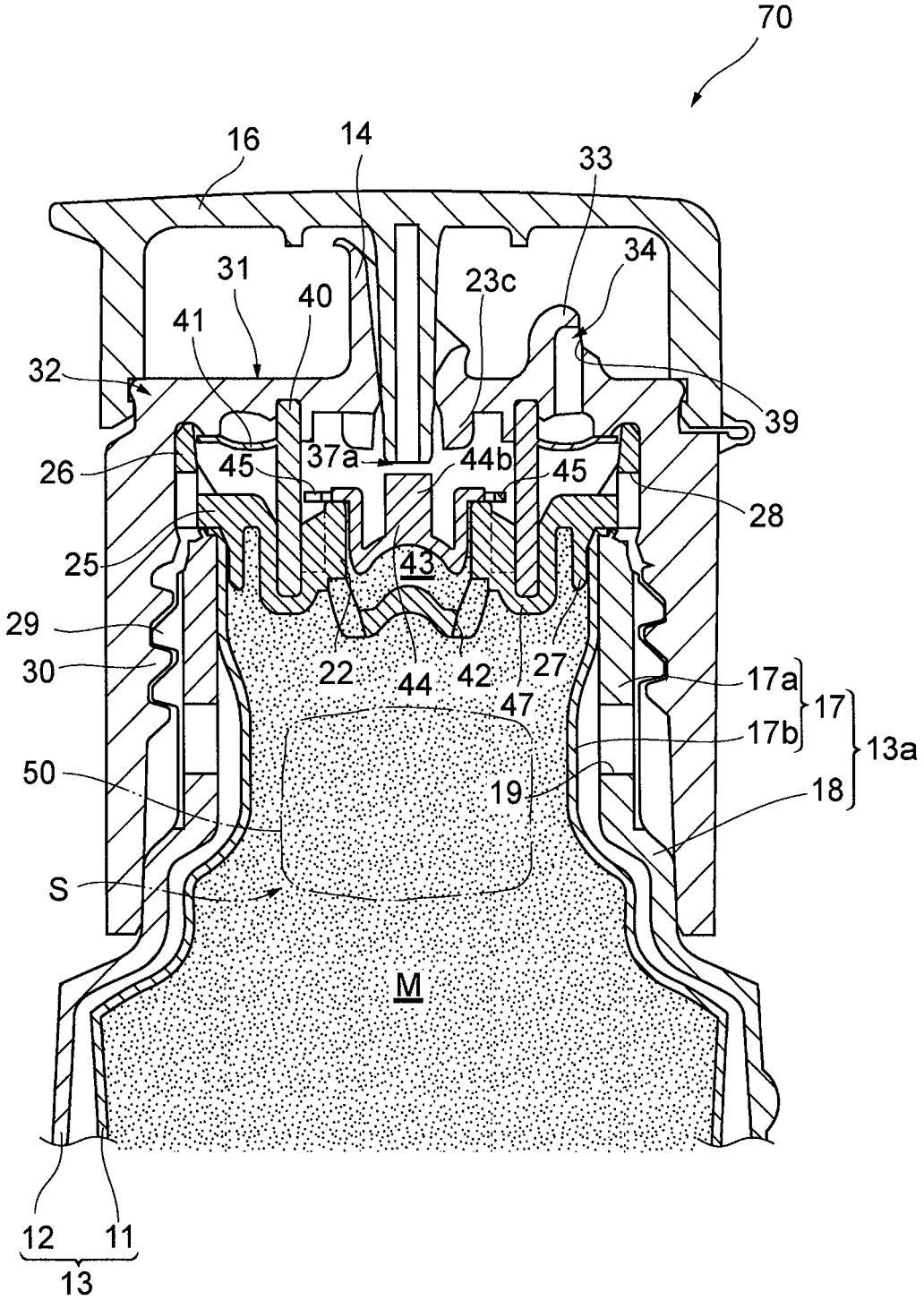
FIG. 12 is a vertical cross-sectional view showing a primary part of a dispensing container according to another embodiment of the present invention.
Figure 13:
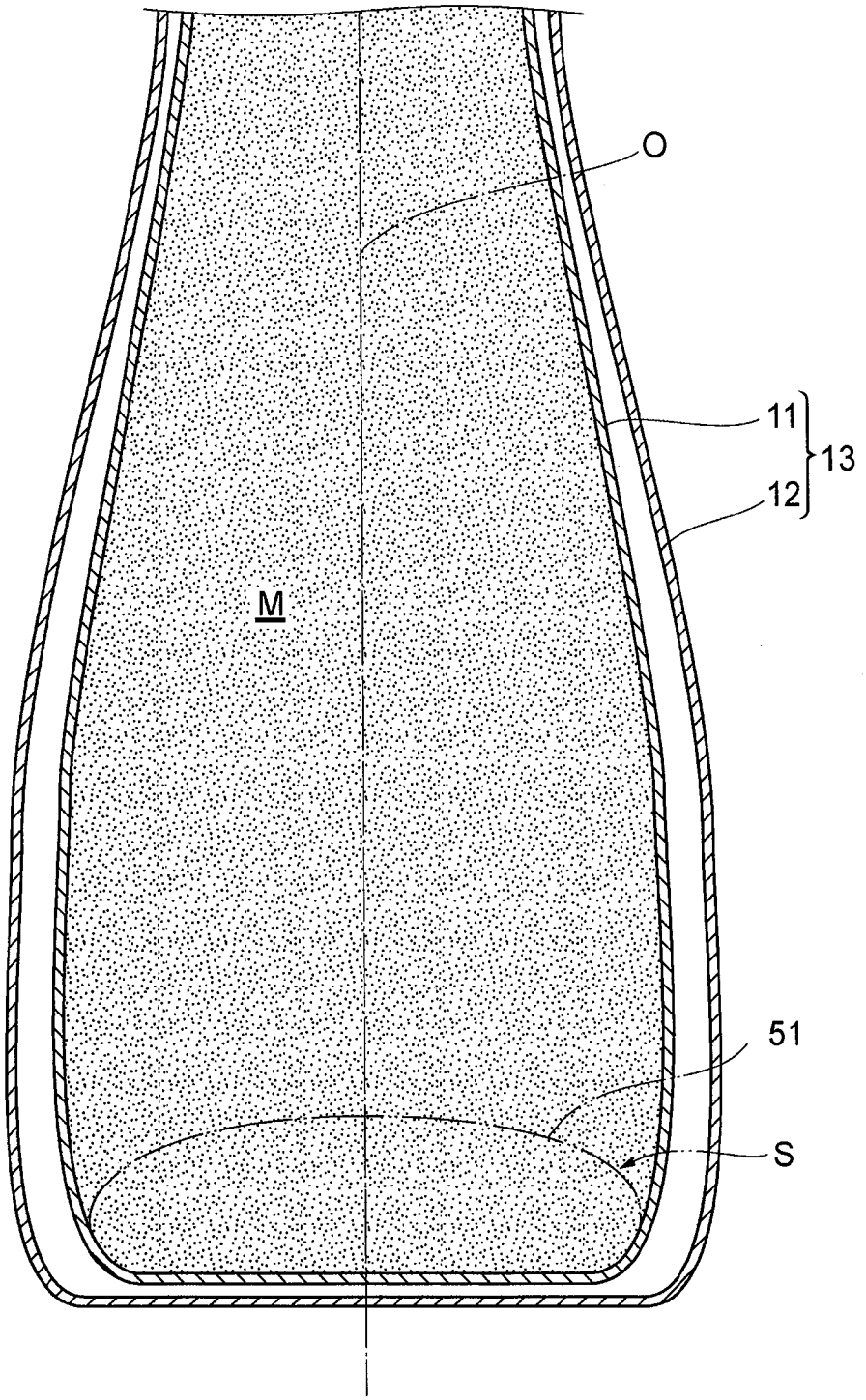
FIG. 13 is a vertical cross-sectional view showing a bottom of a dispensing container according to still another embodiment of the present invention.

Alternatively, the gas space S may be formed by forming a gas chamber 51 at, for example, the bottom on the inside of the internal container 11 and encapsulating the gas in the gas chamber 51 (see FIG. 12). The gas chamber 51 can be formed by, for example, partitioning the interior of the internal container 11 using, for example, a flexible film. In such dispensing container 10 as well, the gas space S is retained in the internal container 11 until all the content M has been discharged.

Example 1

The inventors conducted tests to find out the minimum volume of the gas space S, on the basis of percentage with respect to the volume of the internal container 11 of the dispensing container (delaminating container) 10, that would provide preferable effects.

<Test Method>

Two types of dispensing containers 10 (200 ml and 250 ml) were prepared, the masses thereof were measured, the two containers were filled with content (liquid) while varying the volumes of the gas space S, and then all the content was discharged. The content was discharged 14 to 17 times and a tablespoon (15 ml) of the content was discharged each time. At a point in time when the dispensing containers 10 each finished discharging the content M, the mass thereof was measured in order to calculate the amount of liquid remaining therein. Accordingly, the amount of liquid remaining in the dispensing container 10 and the amount of liquid remaining in the discharge cap 15 were together reflected in the results.

<Result>

Figure 14:
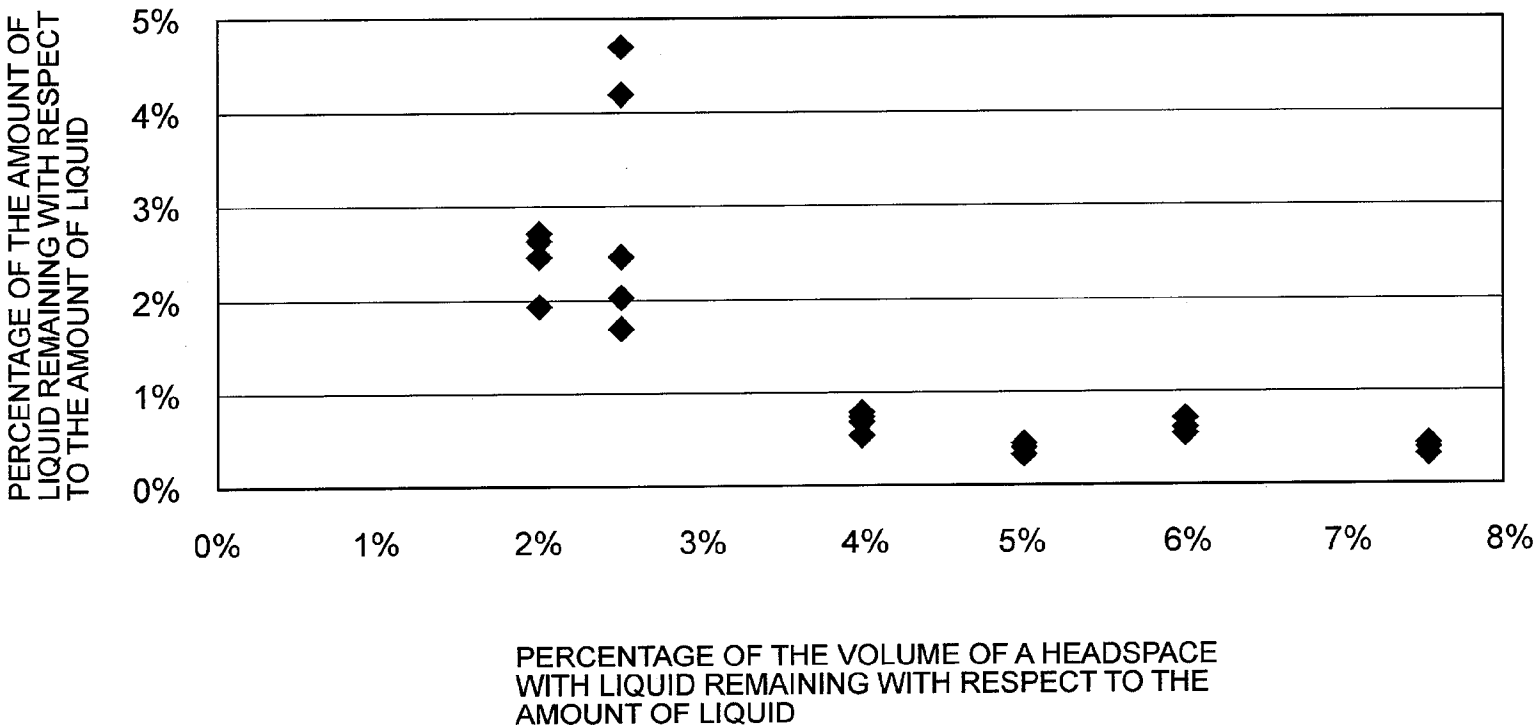
FIG. 14 is a graph showing the test results from Example 1 in the present invention.

The test results are shown in FIG. 14. These test results demonstrated that the amount of remaining content M could be reduced to an extremely small amount when the volume of the gas forming the gas space S was 4% or more of the volume of the internal container 11 (S/(M+S)=4% or more).

Example 2

The inventors conducted tests to verify how the effect of facilitating the discharge of the content M so as to minimize the amount of remaining content M would differ depending on different viscosities of the content M. In this verification, a jelly-type ponzu sauce was used as a high-viscosity liquid-type food.

<Test Method>

The dispensing container was filled with the jelly-type ponzu sauce and this content was discharged in the same way as in the test method in Example 1.

<Result>

The amount of remaining content M could be reduced to a small amount when the volume of the gas space S was 4% or more of the volume of the internal container 11, as in Example 1.

<Result of Viscosity Measurement>

Jelly-Type Ponzu Sauce

Measured using a B-type Viscometer (at 25° C., Rotor No. 3, 12 rpm)

3500 cP

Measured using a B-type Viscometer (at 25° C., Rotor No. 3, 30 rpm)

1840 cP

Soy Sauce

At 25° C., Spindle No. 1, Number of Revolutions: 60 rpm

Instrument used: Brooke Digital Viscometer LVDV-1

| | Viscosity | Brix |
|---|---|---|
| Soy sauce A: | 0.91 cP | 37.42% |
| Soy sauce B | 0.73 cP | 32.21% |
| Soy sauce C | 1.05 cP | 39.37% |

In terms of the object of facilitating the discharge of the content M so as to minimize the amount of remaining content M, it can be said that any liquid-type food having lower viscosity than that of the jelly-type ponzu sauce can be discharged completely.

The present invention is suitably applied to dispensing containers having a delamination structure containing, as the content thereof, an emulsified liquid, a modified starch mixture, a liquid-type food, or the like.

DESCRIPTION OF REFERENCE NUMERALS

| | |
|---|---|
| 10: | dispensing container |
| 11: | internal container |
| 12: | external container |
| 13: | container body |
| 13a: | spout |
| 14: | discharge port |
| 15: | discharge cap |
| 19: | suction port |
| 31: | top part |
| 34: | external-air inlet port |
| 41: | air valve |
| 50: | gas bag |

-continued

| | |
|---|---|
| 51: | gas chamber |
| M: | content |
| S: | gas space |

What is claimed is:

1. A dispensing container, comprising:

a content which is a soy sauce-containing flavoring material;

a container body having a flexible internal container which contains the content and deforms so as to deflate with a decreasing amount of the content and an external container in which the internal container is attached in a delaminatable manner to the external container, where the external container is elastically-deformable and has a suction port which sucks external air in between the internal container and the external container;

a discharge cap attached to a spout of the container body, where a discharge port to discharge the content is disposed on a top part of the discharge cap, an external-air inlet port to communicate the external air from outside of the dispensing container to the suction port is disposed on the top part of the discharge cap, and an overcap is connected via a hinge to cover the discharge port and the external-air inlet port;

an air valve disposed between the external-air inlet port and the suction port and switches between a communicated state and a shutoff state of communication between the external-air inlet port and the suction port; and a gas which is more easily compressed as compared to the content housed in the internal container, the gas having a low reactivity with the content, where a volume of the gas is 4% or more of a volume of the internal container, wherein the gas moves in the internal container when the dispensing containers is tilted to a discharge posture in order to discharge the content from the discharge port.

2. The dispensing container according to claim 1, wherein the gas is encapsulated in a gas bag.

3. The dispensing container according to claim 2, wherein the soy sauce-containing flavoring material is a liquid.

4. The dispensing container according to claim 1, wherein the gas is encapsulated in a gas chamber formed in the internal container.

5. The dispensing container according to claim 4, wherein the soy sauce-containing flavoring material is a liquid.

6. The dispensing container according to claim 4, wherein the gas chamber is disposed at a bottom on an inside of the internal container.

7. The dispensing container according to claim 6, wherein the soy sauce-containing flavoring material is a liquid.

8. The dispensing container according to claim 1, wherein the sauce-containing flavoring material is a liquid.

9. A dispensing container, comprising:

a container body having a deformable, flexible internal container and an elastically-deformable external container, where the internal container is attached in a delaminatable manner to the external container, and the external container has a suction port which sucks external air in between the internal container and the external container;

a discharge cap attached to a spout of the container body, where a discharge port to discharge the content is disposed on a top part of the discharge cap and an external-air inlet port to communicate the external air from outside of the dispensing container to the suction port is disposed on the top part of the discharge cap;

an air valve disposed between the external-air inlet port and the suction port to switch between a communicated state and a shutoff state of communication of the external air between the external-air inlet port and the suction port; and a gas housed in the internal container, wherein the gas occupies 4% or more of a volume of the internal container.

10. The dispensing container according to claim 9, further comprising:

a liquid content housed in the internal container that occupies a remainder of the volume of the internal container.

11. The dispensing container according to claim 10, wherein the liquid content is a soy sauce-containing liquid.

12. The dispensing container according to claim 10, wherein the gas is more easily compressed as compared to the liquid content.

13. The dispensing container according to claim 10, wherein the gas has a low reactivity with the liquid content.

14. The dispensing container according to claim 9, further comprising:

an over-cap connected via a hinge to cover the discharge port and the external-air inlet port.

15. The dispensing container according to claim 9, wherein the gas occupies 4% or more of a volume of the internal container in a non-delaminated state.

16. A dispensing container, comprising:

a liquid content;

a container body having a deformable, flexible internal container and an elastically-deformable external container, where the internal container is attached in a delaminatable manner to the external container to contain the liquid content and deflates according to a volume of the liquid content, and the external container has a suction port which sucks external air in between the internal container and the external container;

a discharge cap attached to a spout of the container body, where a discharge port to discharge the content is disposed on a top part of the discharge cap and an external-air inlet port to communicate the external air from outside of the dispensing container to the suction port is disposed on the top part of the discharge cap;

an air valve disposed between the external-air inlet port and the suction port to switch between a communicated state and a shutoff state of communication of the external air between the external-air inlet port and the suction port; and a gas container that encapsulates a gas, where the gas container is housed in the internal container, and the gas container occupies 4% or more of a volume of the internal container.

17. The dispensing container according to claim 16, wherein the gas container is disposed at a bottom of the internal container.

* * * * *